US007390243B2

(12) United States Patent
Friel, Sr. et al.

(10) Patent No.: US 7,390,243 B2
(45) Date of Patent: Jun. 24, 2008

(54) SHARPENER FOR BLADES OF FOOD SLICERS

(75) Inventors: Daniel D. Friel, Sr., Greenville, DE (US); Jeremy J. Lacombe, Newville, PA (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 11/681,373

(22) Filed: Mar. 2, 2007

(65) Prior Publication Data

US 2007/0207712 A1 Sep. 6, 2007

Related U.S. Application Data

(60) Provisional application No. 60/778,736, filed on Mar. 3, 2006.

(51) Int. Cl.
*B24B 19/00* (2006.01)
*B26B 1/00* (2006.01)
*B26D 7/00* (2006.01)

(52) U.S. Cl. ..... 451/419; 451/420; 30/138; 30/139; 83/174; 83/174.1

(58) Field of Classification Search ..... 451/419–422
See application file for complete search history.

(56) References Cited

U.S. PATENT DOCUMENTS

| | | | | |
|---|---|---|---|---|
| 3,958,478 | A * | 5/1976 | Camper | 451/422 |
| 3,986,304 | A | 10/1976 | Shie | |
| 4,817,480 | A * | 4/1989 | Young | 451/419 |
| 5,591,072 | A * | 1/1997 | Tweed et al. | 451/420 |
| 6,190,244 | B1 | 2/2001 | Jung | |
| 6,261,161 | B1 * | 7/2001 | Yan | 451/419 |
| 6,709,319 | B2 * | 3/2004 | Yan | 451/420 |
| 7,134,937 | B1 * | 11/2006 | Chen et al. | 451/420 |

* cited by examiner

*Primary Examiner*—Maurina Rachuba
(74) *Attorney, Agent, or Firm*—Connolly, Bove, Lodge & Hutz

(57) ABSTRACT

A sharpener to sharpen the edge of a food slicer blade includes a non-planar abrasive surfaced rotatable disk mounted on a supporting structure. The supporting structure includes one or more surfaces designed to align with at least one of a push bar, thickness control plate and the surface of the food carriage of the food slicer when the abrasive surface of the disk is in contact with the edge of the slicer blade.

14 Claims, 3 Drawing Sheets

Fig. 1.
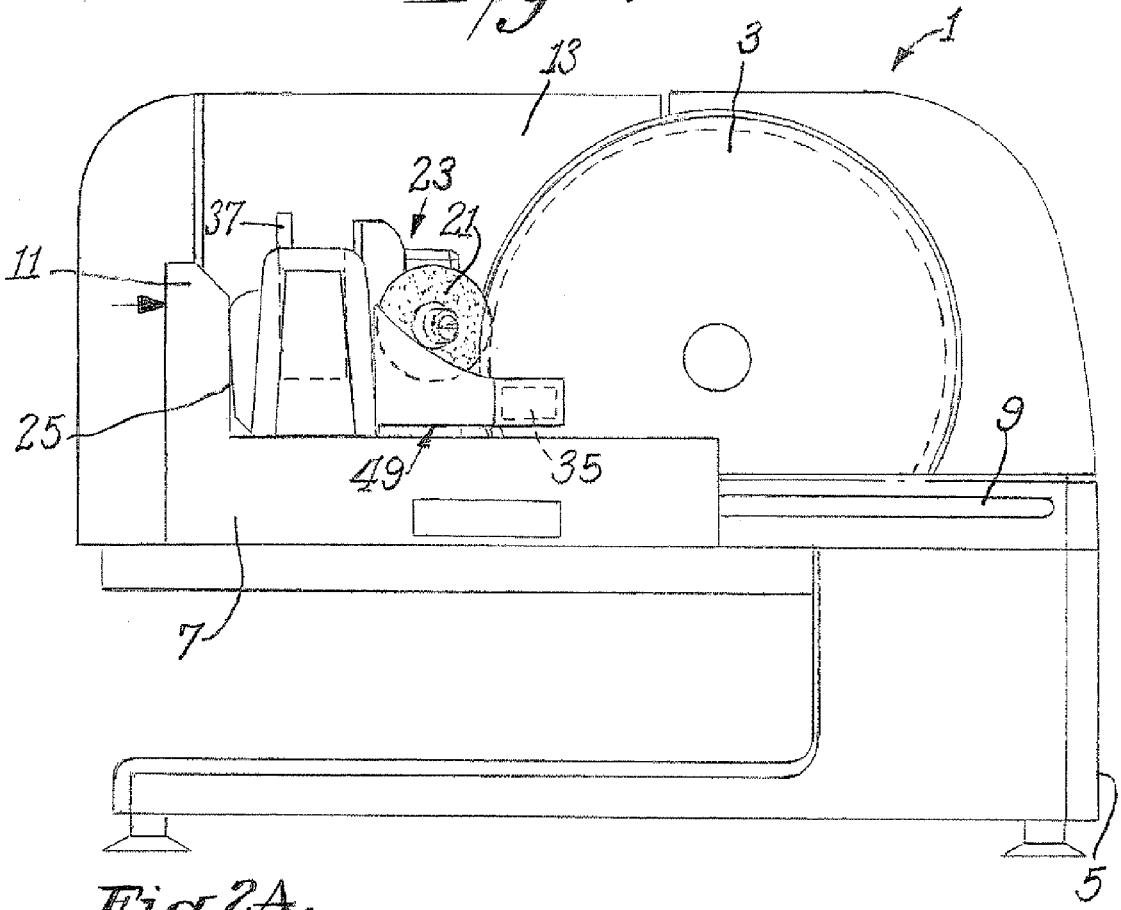
Fig. 2A.
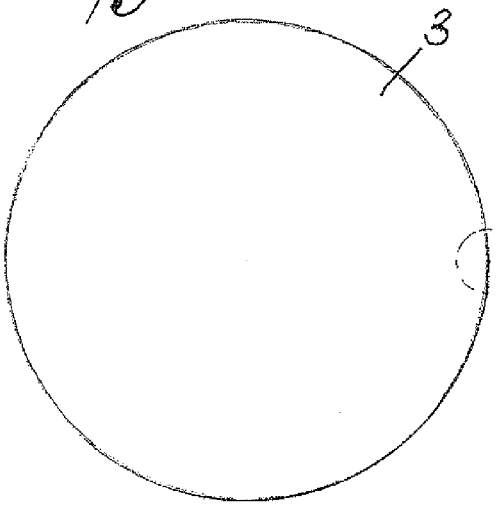
Fig. 2B.
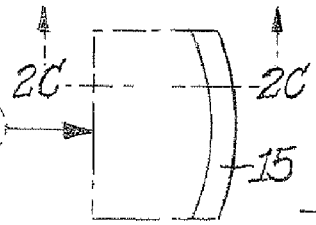
Fig. 2C.
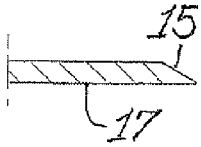
Fig. 3B.
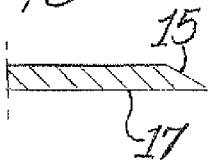
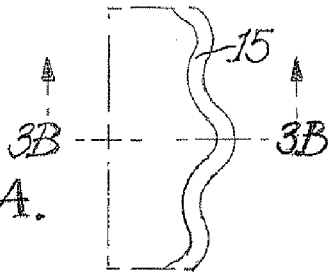
Fig. 3A.

SHARPENER FOR BLADES OF FOOD SLICERS

CROSS REFERENCE TO RELATED APPLICATION

This application is based on provisional application Ser. No. 60/778,736, filed Mar. 3, 2006.

BACKGROUND OF INVENTION

There are a wide variety of sharpeners for slicer blades. Most of these are permanently mounted on the food slicer and are easily activated when the slicer blade becomes dull from use and needs sharpening.

The sharpeners now available are in general designed to be dedicated to a particular slicer with a particular blade size. Virtually all commercially available sharpeners are designed to sharpen only fine edge blades and they are not recommended for or used for serrated blades. Many of the modern slicers, particularly for home use, use serrated blades because they are more efficient and require less power for cutting than the fine edge blades. Generally serrated blades must be sharpened by hand. Fine edge blades when dulled are not as effective as serrated blades. However, both types of blades are used on modern slicers and hence a sharpener should ideally be able to sharpen either type of blade.

There is a need for a sharpener that can be used on a wide variety of food slicers made by different manufacturers. None of the existing sharpeners are versatile enough to accommodate the wide variety of blade sizes and the design of various food carriages that are provided to advance the food into the blade. Existing food slicers are sold with a wide range of blade diameters ranging from about 6" to 12" for the home and with much larger blades if sold for commercial purposes.

SUMMARY OF THE INVENTION

The slicer blade sharpener described here in subsequent sections is a universal sharpener in that it will sharpen blades of widely different diameters from 6" to more than 12" in diameter; its unique design allows it to sharpen both plain edge blades and serrated blades; it is designed to accommodate a wide range of food carriage designs and of different dimensions; and it has a protecting pocket to guard the user's fingers when the slicer blade is being sharpened.

THE DRAWINGS

FIG. 1 is a side elevational view of a food slicer;

FIG. 2A is a side elevational view of a food slicer blade;

FIG. 2B is an enlarged view of the portion of the food slicer blade circled in FIG. 2A;

FIG. 2C is a cross-sectional view taken through FIG. 2B along the line 2C-2C;

FIG. 3A is a view similar to FIG. 2B of an alternative form of food slicer blade;

FIG. 3B is a cross-sectional view taken through FIG. 3A along the line 3B-3B;

DETAILED DESCRIPTION

General Design of the Modern Slicer

Figure 5:
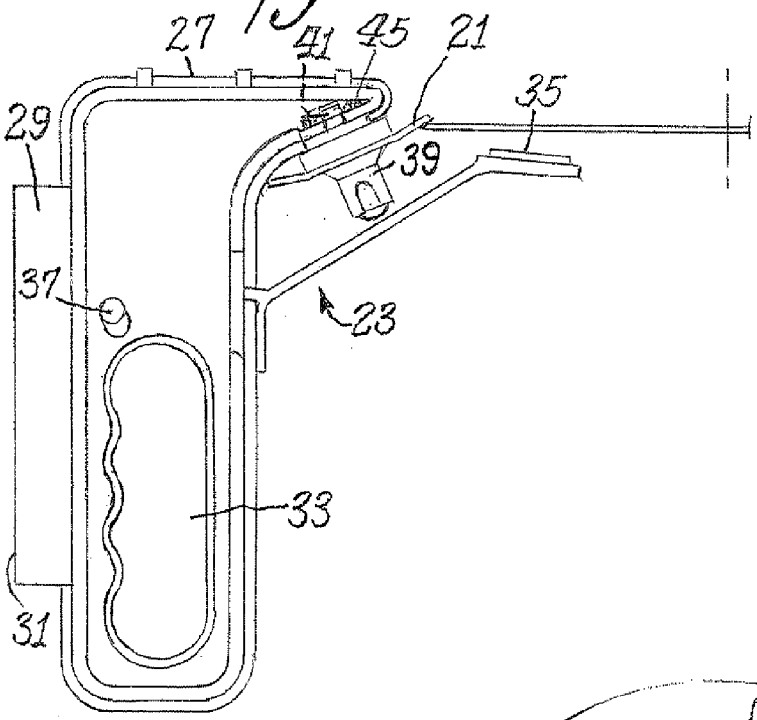
FIG. 5 is a top plan view of the sharpener shown in FIG. 4.

Modem food slicers 1 FIG. 1 provide a motor driven circular blade 3 supported on a rigid plastic or metal base structure 5. The food to be sliced is placed on a movable food carriage 7 that can be advanced manually or mechanically along a supporting platform 9 as the food contacts the moving blade. In the manual mode, the operator pushes the food on the food carriage 7 past the blade forcing the slices to be made and fall along side the blade where they can be collected on a plate or tray. The food carriage is commonly designed with a push bar 11 that serves conveniently to push the carriage but it also serves to guide a food pusher (not shown) needed to press the food against the slicer blade and against a thickness control plate 13 as the food is being sliced. The thickness of a slice is determined by the position of the face of the thickness control plate relative to the cutting edge of the blade. To increase the thickness of a slice the thickness control plate is moved behind the line and plane of the cutting blade. The thickness control plate can be moved back sufficiently to allow slices thicker than one half inch, but most often the user prefers deli-thin slices of meat on the order of 1/16 inch thick. The operator presses a food pusher, which generally is designed to physically hook over the push bar 11, to push against the food and to hold it, as it is being sliced, securely against the thickness control plate in order to obtain uniformly thick slices of food.

Sharpening the Slicer Blade

The fine-edge slicer blade 3 shown in FIGS. 2A and 2B is beveled to create a facet 15 on one side of the edge, FIG. 2C, generally on the side away from the food. The other side 17 of the edge, adjacent the food is not beveled.

As the edge of the blade dulls from use, the edge bends over presenting a dull profile to the food. The hardness of the blade generally determines how long the blade will stay sharp. Harder blades will hold a sharp edge longer. When the edge bends sufficiently it appears dull and will tear the food rather than sever it cleanly.

Many of the less expensive home slicers use serrated blades, FIGS. 3A and 3B, that have either a repetitive wave form as in 3A or a saw tooth structure around the circumference of the blade. The serrated edge is in some designs beveled on both sides of the edge. In general these will not slice foods well into extremely thin slices but the serrated blade does not appear to dull as fast as the fine-edge blade. A fine edge blade can cut very thin slices much better than a serrated blade.

When the fine-edge blade dulls it is necessary to put a new bevel 15 on the beveled side. This requires that metal be removed from the facet until the distorted edge is removed. In the process of removing metal from the facet a burr is created on the other side of the edge. That burr must be removed carefully so that during its removal a new burr is not created on the beveled side of the edge. Generally the burr that is created when reshaping the bevel is removed with a very fine abrasive pad.

Prior Art Sharpeners

Commonly abrasive stone wheels made of natural silica, alumina, or carborundum are used to sharpen slicer blades. Coarser grit sizes are used for re-sharpening the facet and finer grits are used to remove the burr created in sharpening the facet. A major disadvantage of using these particular abrasive materials is that they abrade and wear rapidly making it impossible to hold a consistent sharpening angle. These abrasives can shape the beveled edge of the hardened blade but the facet quickly wears the abrasive sharpening surface and changes its angle. Hence the sharpening angle changes consistently and the abrasive surface must be replaced frequently in order to insure the facet is created at the correct angle.

The abrasive wheel sharpeners commonly used to sharpen the bevel and to remove the burr are very awkward. Their mounting structure is highly complex in order to contact the blade's facet at the correct angle, in order to insure that the abrasive face will rotate in order to effectively grind the edge, and in order to avoid quickly cutting a groove across the abrasive face. Commonly the sharpening wheel assembly is permanently mounted on the slicer frame adjacent the blade. It is designed to be moved slightly from a non-contacting storage position into contact with the slicer blade. The coarse wheel can be moved against the beveled facet and then a fine abrasive wheel is brought into contact with the other side of the edge to remove the burr. Most sharpeners in use today are dedicated to and mounted onto the frame of the food slicer. U.S. Pat. No. 6,709,319B2, U.S. Pat. Nos. 6,190,244B1 and 3,986,304 are typical of the prior art configurations.

Prior art sharpeners almost universally are not designed to sharpen serrated blades. Many of the current sharpeners will damage serrated blades or the serrated blades quickly damage the sharpening stones. This forces the owner of serrated blade slicers to use manual files for sharpening serrated blades which usually must first be removed from the slicer to sharpen them safely. Sharpening slicer blade manually with a flat file is a very tedious and dangerous operation.

Improved Sharpener for Slicer Blades

Figure 4:
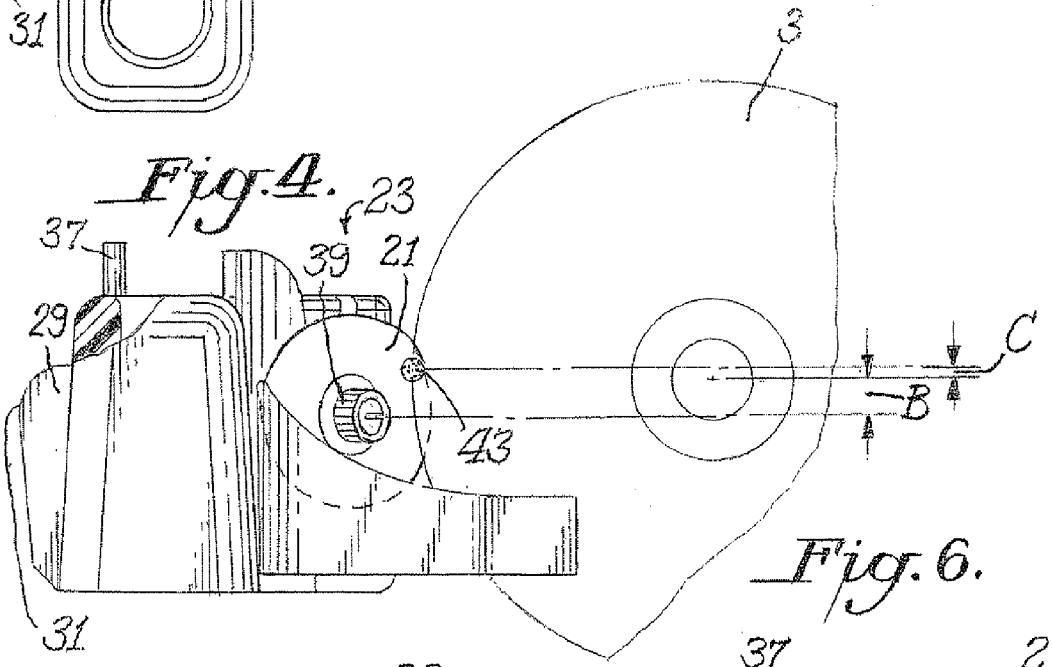
FIG. 4 is a side elevational view partly in section of a food slicer sharpener in accordance with this invention.

The sharpener 23 of this invention (as shown in FIG. 4) has many advantages over the conventional sharpeners for food slicer blades. This novel sharpener, nearly universal in design can be used to sharpen blades of widely different diameters and has been tested successfully on a wide range of slicers of different brands and blade size up to 12 inches in diameter.

Figure 6:
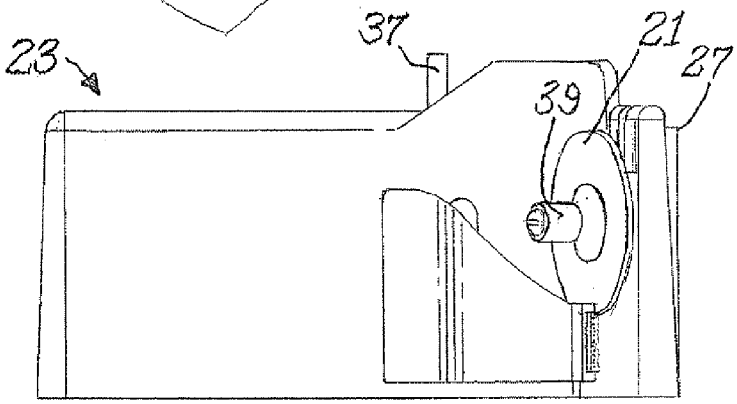
FIG. 6 is an end elevational view of the sharpener shown in FIGS. 4-5.

To sharpen a slicer blade, the sharpener 23, FIG. 5, must be accurately aligned relative to the blade 3. These inventors found that it is extremely convenient and highly accurate to align the abrasive sharpening disk 21 angularly relative to the edge facet 15 of the slicer blade by physically aligning and stabilizing the body of the sharpener against the thickness control plate 13 in FIG. 1. The thickness control plate is usually rigidly mounted and well aligned to be in a plane that is always parallel to the face of the slicing blade. As the thickness control plate is moved to change the thickness of the individual food slices, the plane of the face of that plate remains parallel to the blade face. Consequently it serves as an accurate alignment face for one side of this improved sharpener described here. The push bar 11 on the food carriage 7, FIG. 1 is used as a second alignment face for this new sharpener. The face 25 of the push bar is mounted perpendicular to the thickness control plate 13 and hence perpendicular to the face of the slicer blade. Hence the face 25 of this bar and the face of the thickness control plate form a 90° angled corner. This new sharpener utilized these structural features for precise alignment and is built with a 90° angle between the two adjacent sides, the one side 27, FIGS. 5 and 6, that rests against the thickness control plate 13 and the side 29, FIGS. 4 and 5, that is positioned against the push bar face 25, FIG. 1. The sharpener is hence aligned very precisely relative to the face of the blade and the bevel 15 that establishes the cutting edge.

The supporting structure of this new sharpener incorporates a novel design for the side 29 of the sharpener that is aligned against the push bar 11 of the food carriage. That side of the sharpener is inclined so that a projecting rounded surface 31, FIG. 4, on that side of the sharpener contacts the face of the push bar 25 at a height substantially above the base of the sharpener. This feature provides a very stable contact line between the sharpener and the face of the push bar which on some food carriages is inclined backward toward the user as a convenience in molding the food carriage of which the push bar is an integral part. The long axis of the rounded surface 31 runs parallel to the base of the sharpener and hence parallel to the top surface of the food carriage when the sharpener rests on that surface This rounded surface on the sharpener extends outward beyond the base of the sharpener so that the rounded surface 31 contacts the push bar. This allows the sharpener to be positioned securely against the push bar even if the push bar tapers at its top. This rounded surface serves as the primary contact line between the sharpener and the push bar and prevents the sharpener from being tilted off its recessed base and misaligned with the sloping face of the push bar.

This new sharpener 23 has a convenient gripping pocket 33 for the user's active fingers, which pocket is generally aligned parallel to the rounded surface 31 which as described is aligned against and adjacent to the push bar. Consequently in use the active fingers extending deeply into that pocket pull the rounded surface 31 on that face of the sharpener into firm contact with the push bar and hold the base of the sharpener in intimate contact with the top surface of the food carriage 7. Simultaneously the user slides the 90 degree corner of the sharpener tightly into the corner created by the push bar and the thickness control plate. The abrasive covered sharpening disk 21 used for sharpening the facet 15 of the slicer blade 3 is mounted firmly to the sharpener at a point near the side of the sharpener adjacent the thickness control plate. Alternative physical protruding structures—other than the rounded surface 31 can be used at the location of rounded surface 31 to achieve the same function of insuring contact with a sloping push bar at that height.

Figure 5A:
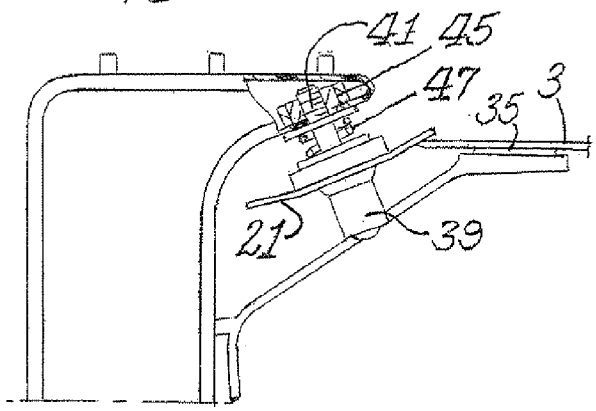
FIG. 5A is a top plan view of a modified form of sharpener in accordance with this invention.

An optional feature for sharpening slicer blades is to incorporate a compression spring 47 behind the sharpening disk 21 in FIG. 5A to hold that disk in constant but sliding contact with the edge facet of the rotating slicer blade. The spring is preferably mounted on the shaft that supports the sharpening disk.

To use this sharpener, the sharpener 23 is mounted on the retracted food carriage 7, FIG. 1, and held as described against both the push bar 11 and the thickness control plate 13. The position of the thickness control plate 13 which is parallel to the plane of the slicer blade is then adjusted to an appropriate position and the sharpener 23 is moved toward the slicer blade 3 by manually pushing the push bar 11 which advances the food carriage 7 on which the sharpener is resting until the surface of the abrasive disk 21, FIG. 7, lightly contacts the facet 15 on the slicer blade. The blade is almost universally beveled on the back side of the blade adjacent the retracted thickness control plate. When the one side of the sharpener is oriented against the thickness control plate, the abrasive surface of the sharpening abrasive wheel 21, (FIG. 7) is set at angle A, commonly angled at 30° to the flat plane of the slicer blade so that the abrasive surface creates a 30° facet on the slicer blade. Most slicer blades are ground at the factory at a 27 to 29° angle. Consequently this sharpener initially puts a small secondary bevel on the edge facet and with repeated sharpenings changes the entire facet angle to 30°.

After the blade 3 is sharpened for about 5 to 10 seconds, the thickness control plate is retracted or the operator can elect to pull the sharpener, on the food carriage, back and away from the slicer blade to terminate the sharpening step. The carriage is moved back enough that a honing pad 35, surfaced with a finer de-burring diamond abrasive grit, will align with the flat (back) side of the slicer blade edge. A small actuating arm 37 on the sharpener adjacent the handle-grip pocket 33 is actuated to bring the de-burring pad 35 into contact with the back side of the edge for just 2-3 seconds to remove the burr created in the sharpening step. The resulting edge facet created in this two step fashion is very well formed and extremely sharp.

The sharpener 23 shown in FIGS. 4, 5, 5A, 6 and 7 proved to be universally applicable to fine edge and serrated slicer blades over a wide range of diameters. Its portable design allows the same sharpener to be used to sharpen interchangeably a wide variety of slicers of different brands.

Figure 7:
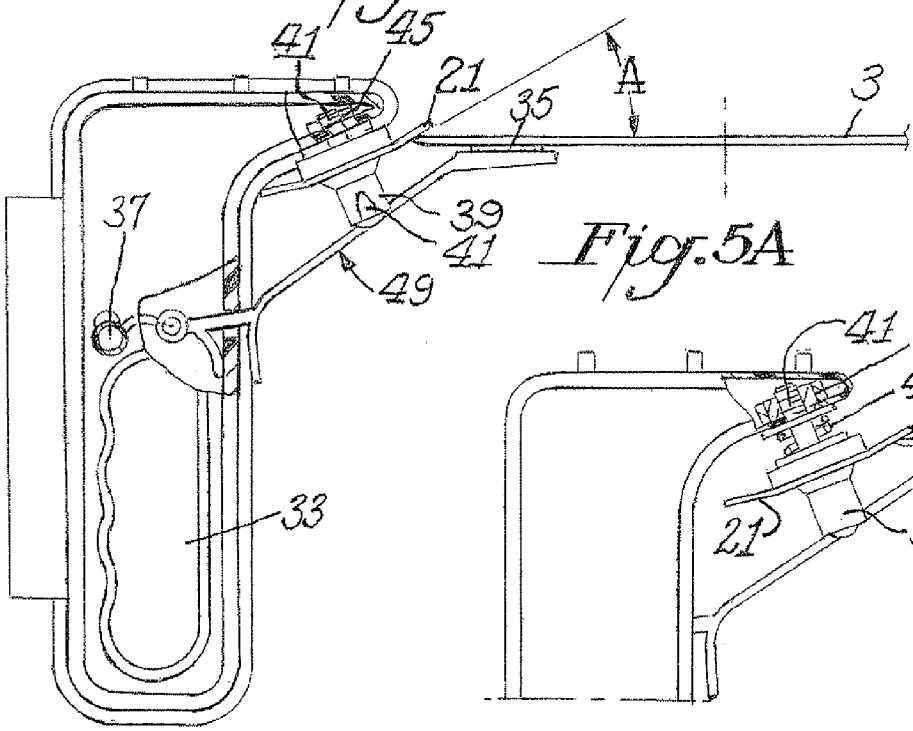
FIG. 7 is a view similar to FIG. 5.
Figure 8:
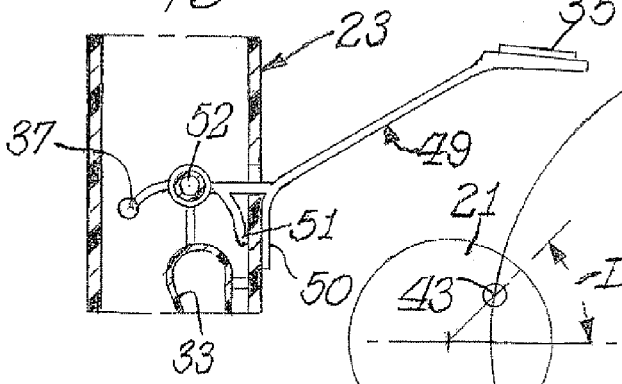
FIG. 8 is a cross-sectional view showing a control arm used in the sharpener of this invention.
Figure 9:
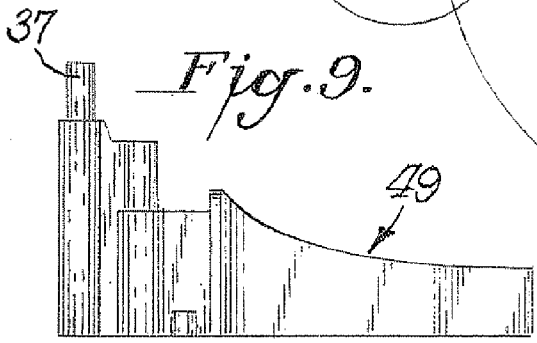
FIG. 9 also illustrates the control arm shown in FIG. 8.

The de-burring pad 35 is mounted on a control arm 49, FIGS. 8 and 9, that extends within the sharpener housing where it is supported pivotally by cylindrical post 52. The control arm terminates at the actuating knob 37 which is accessible to the user, FIG. 7. Spring arms are integral parts of control arm 49 that act to position pad 35 out of contact with the slicer blade 3 until knob 37 is actuated.

Because the active abrasive surface of the sharpening disk is beveled and uses diamond abrasives, it can, when positioned correctly be used to sharpen serrated slicer blades. The diamonds will withstand the rough impact of individual teeth of the serrations. By contacting the blade facet at an appropriate point 43 on the beveled surface of the sharpening disk 21, FIGS. 4 and 4A, the serrated teeth will not "hang up" on the edge of the disk. We found that serrations can catch readily on the edge of flat abrasive disk and damage both the blade edge and the sharpener. The problem of excessive abrasive wear common to natural and carborundum stones commonly used in prior art sharpeners, is eliminated in this new sharpener by using 100% diamond abrasives. These are permanently bonded onto metal disks which would have for example a truncated cone shape. The sharpening disk 21 is molded onto a plastic supporting hub 39, FIG. 4, which is mounted on a close fitting metal shaft 41, FIGS. 5 and 7, that allows that non-planar abrasive coated disk 21 to rotate smoothly while sharpening. The rotation is important to distribute any wear of the diamonds around the disk surface and to create grind lines across the facet of the blade. The best cutting blade edge is one that is ground across, not along, the edge length.

Figure 4A:
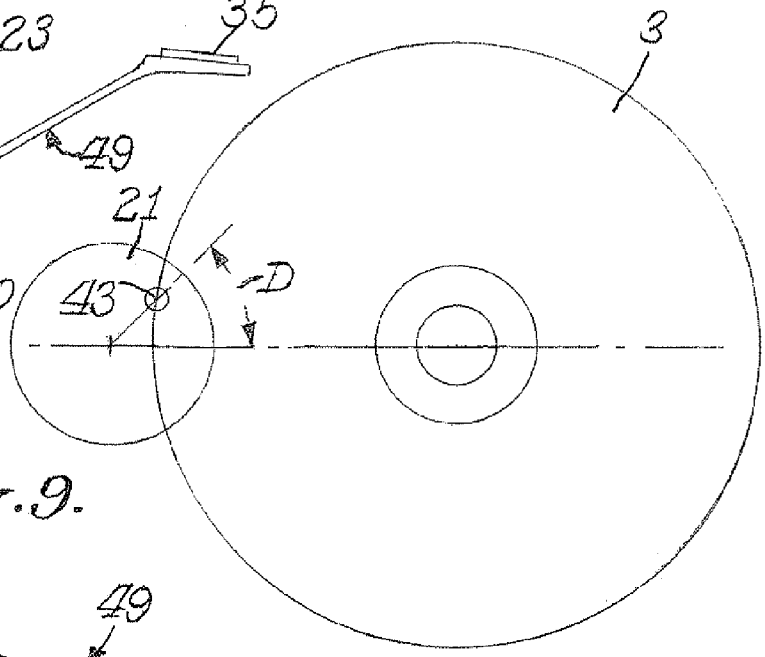
FIG. 4A is a schematic side elevational view representation of the slicer blade and sharpener.

It was found that with sharpener 23 described here the combined rotation of the abrasive disk 21 and the contacting slicer blade 3 when sharpening can create an ideal edge only if the abrasive disk is positioned to contact the slicer blade at an optimum spot at point 43, FIGS. 4 and 4A, on the abrasive surface. It was shown (FIG. 4) with sharpener 23 mounted on the food carriage, the rotational axis of the abrasive disk must be set at a specific height below the blade's horizontal centerline. Surprisingly a special height relationship proved optimum for a sharpener mounted as in FIG. 1 regardless of the blade diameter. Unfortunately the slicer blade on different brands of slicers is set at a different height above the surface of the food carriage which in turn serves as the supporting surface for this new sharpener. This sharpener is therefore designed to permit the height of the sharpening disk to be changed to accommodate the position of the slicer blade.

It was found that in order to sharpen optimally either a fine edge or serrated edge slicer blade 3 the spatial angular relationship of the abrasive sharpening disk 21 and the slicer blade 3 is very critical. It is critical that the contour of the abrasive surface of the disk be beveled, for example to approximate the surface of a truncated cone angled to its axis of rotation as shown in FIG. 7. A flat disk presents a hazard in that as a tooth or wave of a serrated slicer blade passes over the perimeter of a flat sharpening disk, the tooth may engage that perimeter causing physical damage to the disk and blade. For the optimal cutting performance of the slicer blade it is also very desirable that the abrasive particles on the sharpening disk contact and move across the blade facet at an angle of about 30-45 degrees to the edge. That creates a sharper edge with increased "bite", desirable for effective cutting. In order that the abrasive particles move across the blade in this manner the sharpening disks 21 must be of substantially smaller radius than the slicer blade 3. When the power driven rotating slicer blade facet contacts the sharpening disk it sets the smaller disk into rotation about its axis. Because the sharpening disk has a smaller radius, the path of abrasive particles on its surface can cross the slicer blade facet along the shorter radial path of the smaller disk and pass the slicer blade facet at an angle to the edge rather than follow the direction of the large radius of the slicer blade. For slicer blades in the range of 7 inch to 12 inch diameter, the sharpening disk need not be larger than about 2½ inches diameter. It was found that the optimum point of contact 43, described above, of the slicer blade facet with the surface of the sharpening disk is at a radius of ⅝ to ⅞ inch on the sharpening disk and at an angle D, FIG. 4A, of 25 to 60 degrees on that disk as measured from a center line drawn between the axis of the sharpening disk and the axis of the slicer blade. See schematic FIG. 4A.

When the physical sharpener described in this patent rests on the food tray as described, the axis of the sharpening disk is ideally mounted a distance B, FIG. 4, approximately 0.4 to 0.6 inch below the horizontal center line of the slicer blade and the point of contact 43 between the blade facet and the disk is located a distance C about 1/16 to ¼ inch above the horizontal center line of the slicer blade.

With these relationships the sharpener disk receives a very positive rotational thrust from the moving slicer blade that causes the sharpening disk to rotate freely and the abrasive particles abrade across the slicer blade beveled facet at approximately 45° to the edge.

As a consequence of the importance of the vertical positional and resulting angular relationship of the abrading disk with the slicer blade, the height of the abrading disk must be readily adjustable in order to accommodate a wide variety of food slicers. This adjustment allows the subject sharpener to work well on a wide range of slicers even though there is substantial variation in the height of the blade center-line above the surface of the food carriage on which the blade sharpener rests. In order to accommodate this variation between slicers the supporting shaft for the abrasive disk is mounted in a slot-like configuration 45 that allows for adjustment in height of that disk on the sharpener.

The abrasive disk used in this preferred configuration was approximately 2 inches in diameter and the truncated conical disk surface was set at approximately 5 degrees relative to a plane perpendicular to the conical center axis—its axis of rotation.

What is claimed is:

1. A sharpener to sharpen the cutting edge of a rotating slicer blade to be positioned on a horizontal top surface of a food carriage of a powered food slicer having a vertical thickness control plate and a generally vertical push bar adjacent to the control plate, said sharpener comprising a supporting structure having a horizontal base for resting on the horizontal top surface of the carriage, a first vertical wall perpendicular to said base for being disposed against the thickness control plate, a second generally vertical wall adjacent to said first wall, said second wall having a surface shaped to make non-planar contact with the push bar, a sharpening disk having a non-planar rotatable abrasive sharpening surface mounted above said base and inwardly of said first wall and said second wall, said sharpening surface being positioned to contact the cutting edge on one face of the blade to sharpen the cutting edge while the blade cutting edge is free of any structure against the opposite face of the blade directly opposite said sharpening surface during the sharpening, an abrasive surfaced deburring pad selectively movable into contact with the opposite blade face after the blade cutting edge has been sharpened, and said base and said first and second walls permitting said sharpener to be mounted on the slicer without attachment to the slicer during the sharpening and deburring of the slicer blade.

2. A sharpener to sharpen the edge of a slicer blade according to claim 1 where said disk is mounted to have its centerline below the horizontal centerline of the blade with the contact point of said sharpening surface of said disk and the blade being above the centerline of the blade, and said disk being mounted to cause its abrasive particles to cross the edge of the blade at an angle of at least 30° to the edge.

3. A sharpener to sharpen the edge of a slicer blade according to claim 1 where said surface of said second wall is curved to make the linear contact.

4. A sharpener to sharpen the edge of a slicer blade according to claim 1 where said surface of said second wall is inclined away from said base.

5. A sharpener to sharpen the edge of a slicer blade according to claim 1 where said supporting structure includes a protective enclosure for the user's gripping fingers.

6. A sharpener to sharpen the edge of a slicer blade according to claim 1 where said sharpening surface of said disk is a section of a truncated cone.

7. A sharpener to sharpen the edge of a slicer blade according to claim 6 where the truncated cone is beveled.

8. A sharpener to sharpen the edge of a slicer, according to claim 2, where said angle is in the range of 25 to 60 degrees, and the contact point being located in the range of ⅝ to ⅞ inch from the axis of said disk.

9. A sharpener to sharpen the edge of a slicer blade according to claim 1 where said sharpening surface contains diamond abrasive particles.

10. A sharpener to sharpen the edge of a slicer blade according to claim 1 where the vertical position of said disk on said supporting structure can be adjusted.

11. A sharpener to sharpen the edge of a slicer blade of a food slicer according to claim 1 where the center said disk can be positioned approximately 0.4 to 0.6 inch below the horizontal center line of the food slicer blade when positioned on the food carriage,

12. A sharpener to sharpen the edge of a slicer blade according to claim 5 where said protective enclosure is a recessed pocket to protect the user's fingers when sharpening.

13. A sharpener to sharpen the edge of a slicer blade according to claim 1 including a thumb operated lever that moves said deburring pad into contact with the non-faceted face of the slicer blade.

14. A sharpener to sharpen the edge of a slicer blade according to claim 1 where said disk is slidingly supported by said supporting structure and is restrained in position by a spring until displaced during sharpening by the force of contact of said disk with the edge of the slicer blade.

* * * * *